United States Patent [19]

Fabel

[11] Patent Number: 4,652,214

[45] Date of Patent: Mar. 24, 1987

[54] SEAL ARRANGEMENT FOR AN OIL-SEALED ROTARY VACUUM PUMP

[75] Inventor: Ludwig Fabel, Wetzlar, Fed. Rep. of Germany

[73] Assignee: Arthur Pfeifer Vakuummtechnik Wetzlar GmbH

[21] Appl. No.: 737,341

[22] Filed: Feb. 23, 1985

[30] Foreign Application Priority Data

May 30, 1984 [DE] Fed. Rep. of Germany ..... 3420190

[51] Int. Cl.[4] ..... F04B 39/02

[52] U.S. Cl. ..... 417/45; 417/372; 418/88; 418/96; 277/27; 310/87

[58] Field of Search ..... 417/228, 372, 410, 374, 417/45; 418/88, 96; 277/27; 310/87

[56] References Cited

U.S. PATENT DOCUMENTS

| | | | |
|---|---|---|---|
| 1,955,958 | 4/1934 | Greenwald | 417/372 |
| 2,418,707 | 4/1947 | Grout | 417/372 |
| 2,902,205 | 9/1959 | Parker | 417/374 X |
| 3,237,852 | 3/1966 | Shaw | 417/372 |
| 3,311,293 | 3/1967 | Moffatt | 418/101 |
| 3,525,578 | 8/1970 | Le Blanc | 418/13 |
| 3,713,513 | 1/1973 | Harris et al. | 417/372 X |
| 3,746,472 | 7/1973 | Rupp | 417/9 |
| 4,502,842 | 3/1985 | Currier et al. | 417/63 X |

FOREIGN PATENT DOCUMENTS

| | | | |
|---|---|---|---|
| 2758120 | 6/1979 | Fed. Rep. of Germany | 418/96 |
| 1119756 | 7/1968 | United Kingdom . | |
| 1517045 | 7/1978 | United Kingdom . | |

OTHER PUBLICATIONS

WO83/00364 2/1983.

*Primary Examiner*—Carlton R. Croyle
*Assistant Examiner*—Theodore W. Olds
*Attorney, Agent, or Firm*—Toren, McGeady and Goldberg

[57] ABSTRACT

An oil-sealed rotary vacuum pump includes a pump system and an electric drive motor connected by a drive shaft and located within a housing. The housing is divided by a partition into two separate compartments with the pump system in one compartment and the drive motor in the other compartment. The drive shaft extends through a passage in the partition between the two compartments and the passage is arranged so that any leakage flow is directed from the motor compartment into the pump system compartment.

8 Claims, 3 Drawing Figures

SEAL ARRANGEMENT FOR AN OIL-SEALED ROTARY VACUUM PUMP

BACKGROUND OF THE INVENTION

The present invention is directed to a rotary pump and more particularly to a rotary vacuum pump sealed with oil or other suitable liquid with a pump system and an electric drive motor each located within a different compartment in a housing with the compartments separated by a partition and filled with oil or other liquid so that the pump system and the electric drive motor are covered with the oil.

An oil-sealed sliding vane rotary vacuum pump of this general type with a directly coupled drive motor is disclosed in German Offenlegungsschrift No. 26 20 375. The pump system and the motor are separated in the housing by a wall containing communicating apertures affording a circulation of oil. An electric signal generator is mounted on the pump shaft to monitor the speed of rotation.

In such an arrangement a shaft seal between the pump and and an externally mounted, air-cooled drive motor is avoided since such a seal is susceptible to problems. As a result, the sealing effect is considerably improved and the field of application of the pump is considerably broadened.

Nevertheless, considerable problems arise particularly with rotary vacuum pumps when the above arrangement is used in various industrial processes. The range of gaseous substances or vapor phase substances drawn off is in the range of water vapor to corrosive gases with emulsions and corrosive condensates being formed, particularly as a result of compression to over 1000 mbar at operating temperatures of about +90° C. Oil contaminated in such an arrangment passes through the bearing as a result of circulation and through the communicating conduits in the partition entering into the drive motor compartment. Accordingly, the components of the drive motor as well as the electrical connections and the motor bearing are exposed to corrosive attack.

The polymerization of the condensates may even lead to jamming of the motor, because the gap between the stator and the rotor becomes clogged.

Another disadvantage is that the insulation efficiency of the oil in the motor compartment is reduced and may lead to short-circuits.

The operational reliability of the electric drive motor and, accordingly, of the entire pump arrangement is greatly impaired by these disadvantages.

SUMMARY OF THE INVENTION

The primary object of the present invention is to prevent the penetration of contaminated liquid from the pump system compartment into the electric drive motor compartment under all operating conditions.

The present invention includes a rotary pump comprising a pump system, an electric drive motor and a housing. The pump system and the motor are interconnected by a drive shaft. The housing is divided by a partition into two housing compartments with a first housing compartment containing the pump system and the second housing compartment holding the electric drive motor. The housing compartments contain liquid so that a liquid level is present above the pump system and the motor. The drive shaft extends through the partition between the two compartments and a substantially liquid-tight passage is provided in the partition for the drive shaft so that any leakage flow can only pass in the direction from the motor compartment to the pump system compartment.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
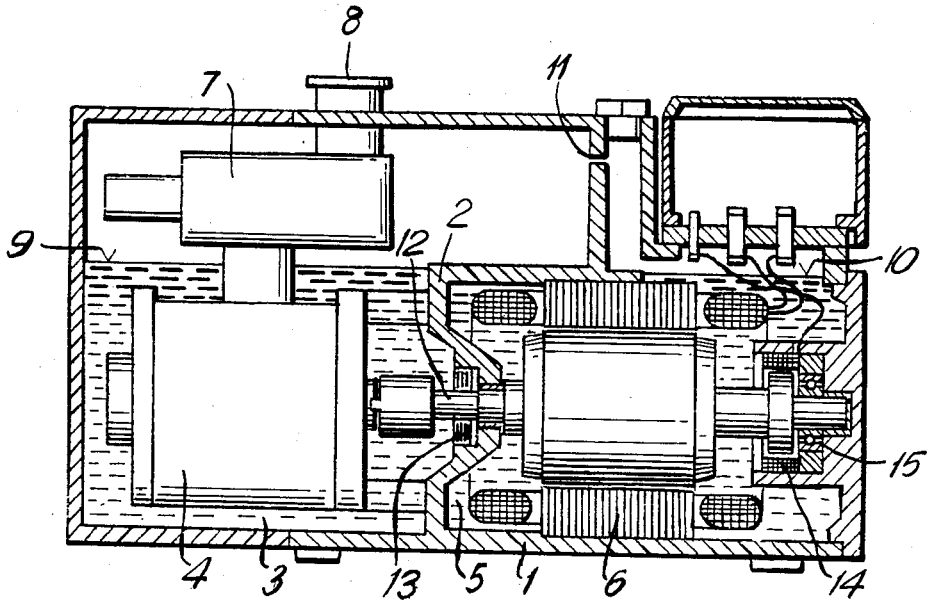
FIG. 1 is a sectional elevational view of a rotary pump embodying the present invention.

Basically, the present invention includes a rotary pump made up of a pump system, an electric drive motor interconnected by a drive shaft with the pump system, and the drive motor each being located within a compartment in a housing separated by a partition. Each compartment is filled with liquid so that the pump system and the electric drive motor are covered. A substantially liquid-tight passage for the drive shaft extending through the partition is afforded so that any leakage flow which may occur passes only in the direction from the drive motor compartment into the pump system compartment.

The drive shaft extends through the partition in a substantially liquid-tight manner, for example, by means of a radial shaft seal or a slide-ring seal, however, the following conditions must be taken into consideration.

1. With all known shaft seals there is a residual leakage, and the direction of such leakage depends on the arrangement, pressure difference, the construction or shape at the point of contact with the rotating shaft and other matching of materials.

2. After start-up, the pump and, as a result, the oil in the motor compartment, is heated from room temperature to an operating temperature of about +90° C. The oil in the motor compartment expands and produces an excess pressure.

3. When the system is switched off, the pump cools down and a reduced pressure results in the motor compartment.

Accordingly, the shaft seal would normally be exposed to alternating pressure conditions so that the leakage flow may take place in either direction based on the operating state.

Preferably the application of pressure should be avoided and constant pressure conditions should be established. In one embodiment of the present invention, this goal is achieved by providing means for pressure equalization between the two compartments at a location above the oil level.

Under such conditions, it is possible to direct the very slight leakage which occurs from the motor compartment into the pump system compartment.

When a slide-ring seal is used, for example, the installation is effected so that the oil penetrating into the radial sealing surface counteracts the contaminated oil due to the action of centrifugal force, that is, the flow through the seal is conducted in the direction into the pump system compartment.

Accordingly, the larger diameter of the radially sliding surface of the seal must be located at the pump system compartment side.

In another embodiment for preventing the passage of contaminated oil from the pump system compartment into the electric drive motor compartment includes a pressure chamber in which a reduced pressure is produced, for example, by the suction action of an oil feed pump. Preferably, the oil feed pump is disposed in the compartment enclosing the pump system between the partition and the pump system. In this arrangement a constant reduced pressure is purposely established by the oil feed pump and directs any leakage flow in the desired direction.

Furthermore, it is important, for the operational reliability of the pump, to locate any rotation-monitoring means, such as an electric generator, and any reverse-rotation-preventing means, such as a pawl stop, from the pump system compartment containing the contaminated liquid into the cleaner drive motor compartment.

With regard to the drawings, FIG. 1 illustrates a housing 1 with a partition 2 within the housing and dividing it into a first compartment 3 for the pump system 4 and a second compartment 5 for the electric drive motor 6.

Above the pump system 4 a valve 7 with a suction stub 8 is provided. The oil fills the first compartment 3 of the pump system up to a level 9 and fills the second compartment to a level 10 above the electric drive motor 6.

The liquid-tight passage 13 around the drive shaft 12 is located in the partition 2. In the cleaner compartment 5 holding the electric drive motor 6 there are a rotation-monitoring electric generator 14 and a pawl stop 15 mounted on the drive shaft 12.

Figure 2:
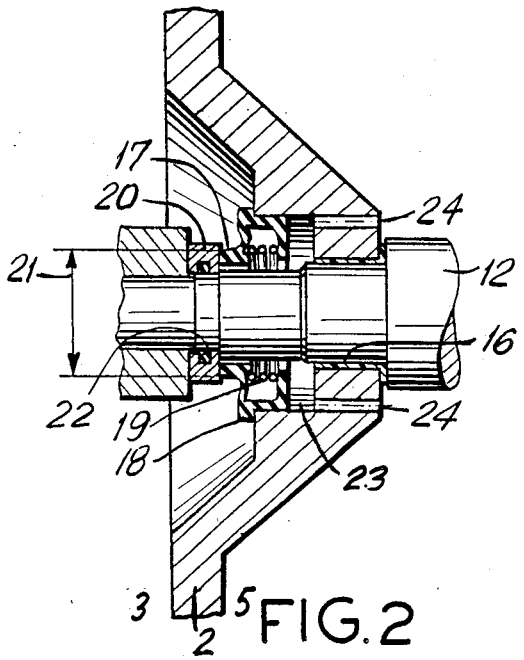
FIG. 2 is an enlarged detail view of the liquid-tight passage for the drive shaft of FIG. 1 with a slide-ring seal.

In FIG. 2 one arrangement of the liquid-tight passage 13 of the drive shaft 12 with a slide-ring seal 17–20 is illustrated.

A plain bearing 16 for the drive shaft 12 is located in the partition 2. The first compartment 3 for the pump system 4 is located on the left-hand side of the partition 2 and a second compartment 5 for the electric drive motor 6 is provided on the right-hand side. A stationary slide ring 17 on a resilient seal carrier 18 is biased, by a compression spring 19, against a rotating counter-ring 20 located on the shaft 12. Between the slide ring 17 and the counter-ring 20 a sealing surface is located with the larger diameter 21 of the surface positioned at the first compartment 3 side of the pump system 4 so that any oil passing through the passage 13 is conveyed in the direction toward the first compartment 3 by the action of centrifugal force.

The counter-ring 20 is sealed on the drive shaft 12 by a sealing ring 22. A gap 23 is formed between the plain bearing 16 and the slide-ring seal 17–20 with the gap in communication with the second compartment 5 via the bores 24.

Figure 3:
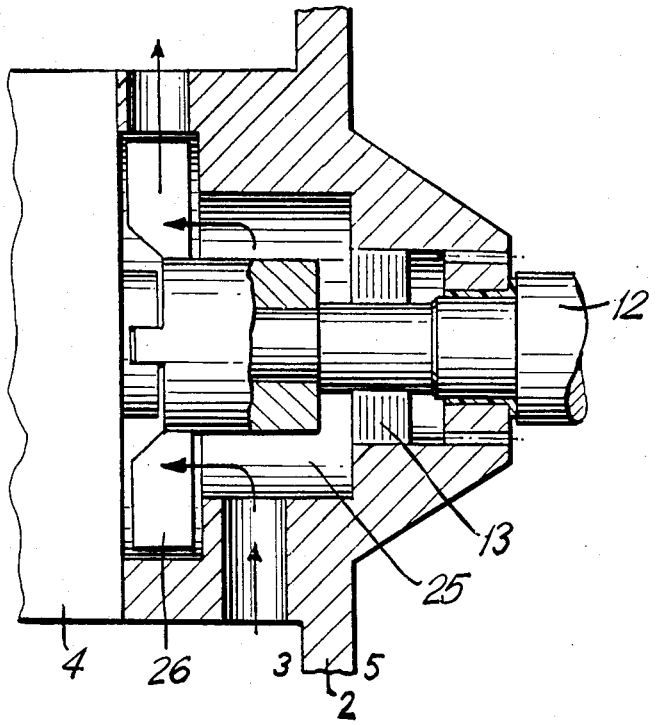
FIG. 3 is a sectional view illustrating the liquid-tight passage in FIG. 1 with a reduced-pressure compartment and an oil feed pump.

In FIG. 3 an oil feed pump 26 is located on the shaft 12 between the pump system 4 and the partition 2. A constant reduced-pressure compartment 25 is formed around the drive shaft 12 adjacent the passage 13. The flow of oil developed by the oil feed pump 26 is indicated by the arrows.

The arrangements in FIGS. 2 and 3 may be used together, or only one of them may be employed.

While specific embodiments of the invention have been shown and described in detail to illustrate the application of the inventive principles, it will be understood that the invention may be embodied otherwise without departing from such principles.

I claim:

1. A rotary pump comprising a pump system, an electric drive motor, and a housing, a drive shaft connecting said pump system and said drive motor, a partition located within said housing and dividing the interior of said housing into a first compartment and second compartment, said pump system located within said first compartment, said drive motor located within said second compartment, each of said first and second compartments arranged to contain liquid with a liquid level therein covering the one of said pump system and drive motor contained therein and said drive shaft extending through said partition between said pump system and said drive motor below the liquid level, means forming a substantially liquid-tight passage through said partition for said drive shaft below the liquid level and extending from said second compartment into said first compartment and arranged so that any leakage flow only takes place from said second compartment into said first compartment.

2. A rotary pump, as set forth in claim 1, wherein said means comprises a slide-ring seal for the drive shaft located between said first and second compartments.

3. A rotary pump, as set forth in claim 2, wherein said slide-ring seal includes a seal gap with a smaller diameter and a larger diameter, said seal being arranged with said larger diameter seal gap located at the side of said seal adjacent to said first compartment.

4. A rotary pump, as set forth in claim 1, including a chamber within said housing, a liquid feed pump located in said chamber, said liquid feed pump arranged to produce a suction with the suction producing a reduced pressure in said chamber.

5. A rotary pump, as set forth in claim 4, wherein said liquid feed pump is located in said first compartment between said partition and said pump system.

6. A rotary pump, as set forth in claim 1, including pressure-equalization connection means between said first and second compartments and located above the liquid level in said first and second compartments.

7. A rotary pump, as set forth in claim 1, including means for monitoring the rotation of said drive shaft, said rotation-monitoring means are located in said second compartment.

8. A rotary pump, as set forth in claim 1, including means for preventing reverse rotation of said drive shaft, and said reverse rotation prevention means being disposed in said second compartment.

* * * * *